US009994343B2

(12) United States Patent
Wetsch

(10) Patent No.: US 9,994,343 B2
(45) Date of Patent: Jun. 12, 2018

(54) REPLACEABLE BLADE

(71) Applicant: Pregis Innovative Packaging LLC, Deerfield, IL (US)

(72) Inventor: Thomas D. Wetsch, St. Charles, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 826 days.

(21) Appl. No.: 13/844,741

(22) Filed: Mar. 15, 2013

(65) Prior Publication Data

US 2014/0261752 A1 Sep. 18, 2014

(51) Int. Cl.

| | |
|---|---|
| ***B65B 3/04*** | (2006.01) |
| ***B65B 41/16*** | (2006.01) |
| ***B65B 41/18*** | (2006.01) |
| ***B65B 43/36*** | (2006.01) |
| ***B65B 51/16*** | (2006.01) |
| ***B65B 51/18*** | (2006.01) |
| ***B65B 55/20*** | (2006.01) |
| ***B65B 61/06*** | (2006.01) |
| ***B31D 5/00*** | (2017.01) |

(52) U.S. Cl.

CPC ..... *B65B 41/16* (2013.01); *B31D 5/0073* (2013.01); *B65B 41/18* (2013.01); *B65B 43/36* (2013.01); *B65B 51/16* (2013.01); *B65B 51/18* (2013.01); *B65B 55/20* (2013.01); *B65B 61/065* (2013.01); *B31D 2205/0047* (2013.01); *B31D 2205/0058* (2013.01); *B31D 2205/0082* (2013.01); *B65B 2220/22* (2013.01); *Y10T 137/3584* (2015.04)

(58) Field of Classification Search

CPC ..... B65B 3/04; B65B 31/021; B65B 31/024; B26D 3/001; B26D 1/01; B26D 1/02; B26D 1/025; B26D 2001/004; B65H 35/02

USPC ..... 30/286, 154, 153; 83/523, 546, 440.2; 53/403

See application file for complete search history.

(56) References Cited

U.S. PATENT DOCUMENTS 1,128,663 A * 2/1915 Conness ..... B26B 27/00 30/290
2,730,800 A * 1/1956 Bailey ..... B26B 5/006 30/153
3,002,273 A * 10/1961 Merritt ..... B26B 27/005 30/158

(Continued)

OTHER PUBLICATIONS

"PCT International Search Report and Written Opinion", PCT International Search Report and Written Opinion dated Aug. 5, 2014 for International Application No. PCT/US2014/028924, 9 pages.

(Continued)

*Primary Examiner* — Hemant M Desai
*Assistant Examiner* — Eduardo R Ferrero
(74) *Attorney, Agent, or Firm* — Dorsey & Whitney LLP

(57) ABSTRACT

A flexible structure inflation device, comprising an inflation assembly configured for insertion between first and second overlapping film layers of a web of material, the inflation assembly having a fluid conduit configured directing a fluid in between the layers to inflate the web; and a cutting member held magnetically in an operative position adjacent the inflation assembly to cut the film passing over the inflation assembly.

30 Claims, 12 Drawing Sheets

(56) References Cited

U.S. PATENT DOCUMENTS 3,678,581 A * 7/1972 Bolduc ..... B26D 1/025 30/294
3,682,031 A * 8/1972 Degelleke ..... B26D 5/04 242/525.5
3,781,988 A * 1/1974 Jones ..... B26B 29/02 30/2
3,981,215 A * 9/1976 Granger ..... B26D 1/025 83/455
4,017,351 A * 4/1977 Larson ..... B29C 49/0047 156/145
4,094,217 A * 6/1978 Exline ..... B26D 1/035 83/368
4,175,460 A * 11/1979 McPhail ..... B26D 1/025 83/425
4,345,497 A * 8/1982 Cobleigh ..... B26D 1/025 83/102
4,422,359 A * 12/1983 Leboeuf ..... B26D 5/02 83/546
4,693,157 A * 9/1987 Looser ..... B26D 1/0006 83/431
4,747,434 A * 5/1988 Jones, Jr. ..... B27G 17/00 144/162.1
4,878,408 A * 11/1989 Isaacson ..... B26D 1/025 83/444
4,979,413 A * 12/1990 Beller ..... B26D 1/02 83/444
5,036,739 A * 8/1991 Clar ..... B41J 11/68 83/422
5,097,733 A * 3/1992 Benkoski ..... B26D 1/02 30/278
5,207,696 A * 5/1993 Matwijcow ..... A61B 17/3211 30/151
5,259,543 A * 11/1993 Downing ..... B26D 1/0006 225/106
5,718,528 A * 2/1998 Halket ..... B26D 1/025 400/615.2
5,975,456 A * 11/1999 Bodkin ..... B26D 1/025 242/525.3
6,209,286 B1 * 4/2001 Perkins ..... B31D 5/0073 156/145
6,260,461 B1 * 7/2001 Mok ..... A62B 99/00 30/160
6,460,313 B1 * 10/2002 Cooper ..... B31D 5/0073 53/493
6,578,266 B2 * 6/2003 Chomiak ..... B26B 5/005 30/2
7,059,097 B2 * 6/2006 Perkins ..... B31D 5/0073 53/403
7,174,696 B2 2/2007 Perkins et al.
7,185,474 B2 * 3/2007 Perkins ..... B31D 5/0073 53/403
7,503,247 B2 * 3/2009 Cavanagh ..... B26D 1/035 83/563
8,353,109 B2 * 1/2013 Rohrbach ..... B26B 5/003 30/151
2002/0094393 A1 * 7/2002 Matarasso ..... B31D 5/0073 428/34.1
2004/0016332 A1 * 1/2004 Price ..... B26D 1/065 83/455
2004/0112195 A1 * 6/2004 Lorenzi ..... B26D 1/09 83/546
2004/0206050 A1 * 10/2004 Fuss ..... B31D 5/0073 53/403
2005/0132865 A1 * 6/2005 Wridge, Jr. ..... B26D 7/2628 83/881
2006/0042184 A1 3/2006 Perkins et al.
2007/0062356 A1 3/2007 Cavanagh
2007/0157554 A1 * 7/2007 Liao ..... B26D 1/0006 53/373.4
2007/0251190 A1 * 11/2007 Daigle ..... B29C 65/18 53/403
2008/0066852 A1 3/2008 Wetsch et al.
2008/0163493 A1 7/2008 Votolato

OTHER PUBLICATIONS

Chinese Office Action issued in related application No. 201480026383.8, dated Aug. 26, 2016 (13 pages).
Extended European Search Report for Appln. No. 14762865.5, dated Jul. 27, 2016 (7 pages).

* cited by examiner

REPLACEABLE BLADE

FIELD OF DISCLOSURE

The present disclosure relates to packaging materials. More particularly, the present disclosure is directed to devices and methods for manufacturing inflatable cushions to be used as packaging material.

BACKGROUND

A variety of inflated cushions are well known and used for sundry packaging applications. For example, inflated cushions are often used as void-fill packaging in a manner similar to or in place of foam peanuts, crumpled paper, and similar products. Also for example, inflated cushions are often used as protective packaging in place of molded or extruded packaging components.

Generally, inflated cushions are formed from films having two layers that are joined together by seals. The seals can be formed simultaneously with inflation, so as to capture air therein, or prior to inflation to define a film configuration having inflatable chambers. The inflatable chambers can be inflated with air or another gas or thereafter sealed to inhibit or prevent release of the air or gas.

Such film configurations can be stored in rolls or fan-folded boxes in which adjacent inflatable cushions are separated from each other by perforations. During use, a film configuration is inflated to form cushions, and adjacent cushions or adjacent stands of cushions are separated from each other along the perforations.

A variety of film configurations are currently available. Many of these film configurations include seal configurations that tend to waste material, inhibit separation of adjacent inflated cushions, and/or form inflated cushions that are susceptible to under-inflation or leakage, thereby inhibiting utility.

SUMMARY

An inflation device for inflating a flexible structure, for instance to inflate a web of film to provide inflatable cushions is disclosed. An embodiment of the device has an inflation assembly configured for insertion between first and second overlapping film layers. The inflation assembly can have a fluid conduit configured for directing a fluid in between the layers to inflate a web of material. A cutting member can be held magnetically in an operative position adjacent the inflation assembly to cut the film passing over the inflation assembly.

The inflation assembly can have an inflation nozzle through which the fluid conduit extends and that is elongated to fit within an inflation channel between the first and second layers. The cutting member in the operative association with the inflation nozzle can be positioned to cut the inflation channel open to allow the first and second layers to move off from the inflation nozzle. A driving member can be configured for advancing the film along a material path in an inflation direction over the inflation nozzle. In an embodiment, the cutting member includes a blade held stationary with respect to the nozzle in the operative position to cut open the channel as the film is moved along the material path. Also, the elongated inflation nozzle can be configured and oriented to be received longitudinally within the inflation channel defined between the first and second layers to direct fluid therebetween.

A cutter holder can be used to hold the cutting member, and the cutting member can be magnetically held to the inflation assembly via the cutter holder. A first magnet can be associated with the cutter holder or the inflation assembly. A magnetic member can be associated with the other of the cutter holder or inflation assembly held magnetically. The first magnet and the magnetic member can magnetically hold the cutter holder in the operative position. In an embodiment, the magnetic member includes a second magnetic.

One embodiment has a cutter assembly that includes the cutter holder and a door depending from the cutter holder and that is movable with respect to the cutting member in the cutter holder between an open position to expose the cutting member in the operative position and a closed position to cover a sharp portion of the cutting member in the inoperative position. An embodiment can have a sealing assembly disposed and configured to seal the first and second layers together to trap the fluid within the web to provide an inflated cushion. The cutting member can include a blade, which is partially received and partially exposed from the inflation assembly in the operative position.

In some embodiments, a guide can associate the inflation assembly with the cutting member to guide the cutting member between the operative position and an inoperative position. In the inoperative position, the cutting member can be removable and replaceable from the guide. A cutter holder may be provided that holds the cutting member and is associated with the guide, the guide guiding the movement of the holder to move the cutting member between the operative and inoperative positions. The guide can include a track associated with the inflation assembly leading towards and away therefrom, and the cutter holder can include a follower guided by the track between the operative and an inoperative positions. The track preferably guides the cutter holder along a cutter path, the track being open on one side transverse to the path to allow the follower to be removed from or positioned on the track at various locations along the track.

The inflation assembly can have an inflation nozzle through which the fluid conduit extends and that is elongated to fit within an inflation channel between the first and second layers. In the operative position, the cutting member may be partially received in the inflation assembly, and in the inoperative position, the cutting member can be spaced from the inflation assembly. A magnet can hold the cutting assembly in the operative position magnetically. A sealing assembly can be disposed and configured to seal the first and second layers together to trap the fluid within the web to provide an inflated cushion.

In some embodiments, the door is configured to automatically close when the cutter assembly is moved out of the operative position. The door can configured to automatically open to expose the cutting member when the cutting assembly is moved to the operative position. A guide structure is provided in some embodiments, associating the inflation assembly with the cutting assembly to guide the cutting member between the operative position and an inoperative position and to move the door open and closed as the cutting assembly is moved between the operative and inoperative positions.

DETAILED DESCRIPTION OF PREFERRED EMBODIMENTS

The present disclosure is related to systems and methods for converting uninflated material into inflated cushions that may be used as cushioning or protection for packaging and shipping goods. Illustrative embodiments will now be described to provide an overall understanding of the disclosed apparatus. Those of ordinary skill in the art will understand that the disclosed apparatus can be adapted and modified to provide alternative embodiments of the apparatus for other applications, and that other additions and modifications can be made to the disclosed apparatus without departing from the scope of the present disclosure. For example, features of the illustrative embodiments can be combined, separated, interchanged, and/or rearranged to generate other embodiments. Such modifications and variations are intended to be included within the scope of the present disclosure.

Figure 1:
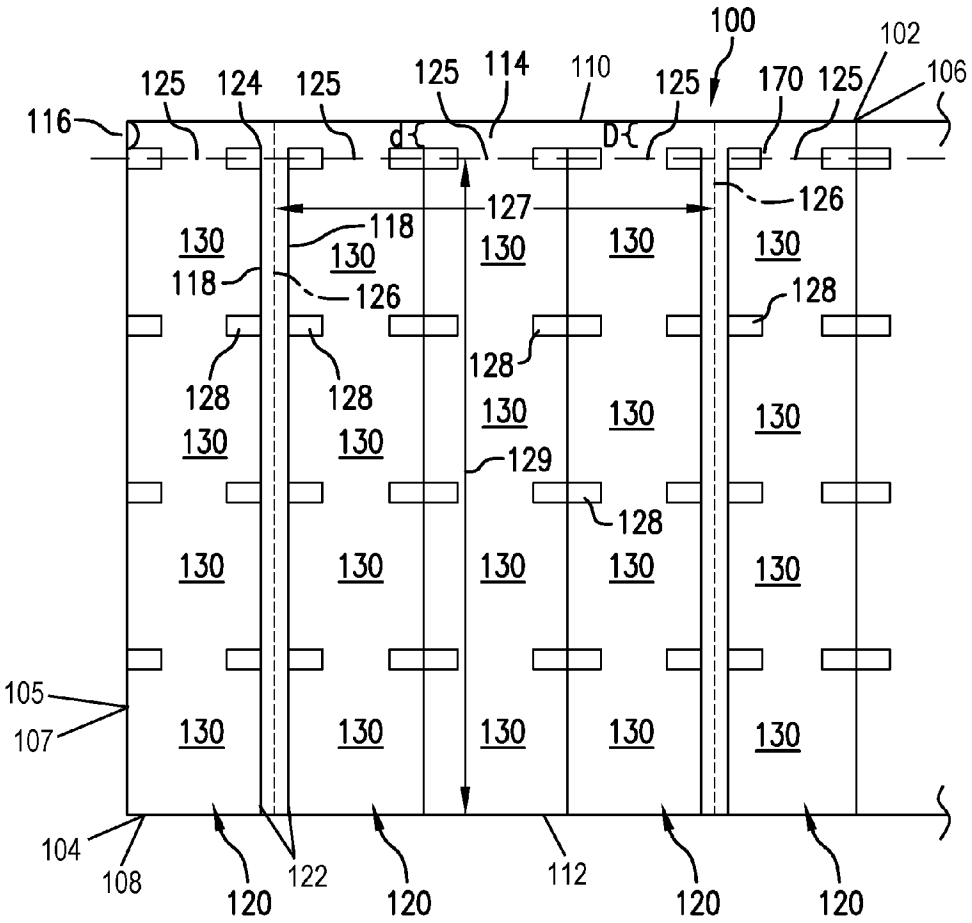
FIG. 1 is a top view of an uninflated material web according to an embodiment.

As shown in FIG. 1, a flexible structure, such as a multi-layer web 100 of film, for inflatable cushions is provided. The web includes a first film layer 105 having a first longitudinal edge 102 and a second longitudinal edge 104, and a second film layer 107 having a first longitudinal edge 106 and a second longitudinal edge 108. The second web layer 107 is aligned to be over lapping and can be generally coextensive with the first web layer 105, i.e., at least respective first longitudinal edges 102,106 are aligned with each other and/or second longitudinal edges 104,108 are aligned with each other. In some embodiments, the layers can be partially overlapping with inflatable areas in the region of overlap.

FIG. 1 illustrates a top view of the web 100 having first and second layers 105,107 joined to define a first longitudinal edge 110 and a second longitudinal edge 112 of the film 100. The first and second web layers 105,107 can be formed from a single sheet of web material, a flattened tube of web material with one edge slit, or two sheets of web material. For example, the first and second web layers 105,107 can include a single sheet of web material that is folded to define the joined second edges 104,108 (e.g., "c-fold film"). Alternatively, for example, the first and second web layers 105,107 can include a tube of web material (e.g., a flatten tube) that is slit along the aligned first longitudinal edges 102,106. Also, for example, the first and second web layers 105,107 can include two independent sheets of web material joined, sealed, or otherwise attached together along the aligned second edges 104,108.

The web 100 can be formed from any of a variety of web materials known to those of ordinary skill in the art. Such web materials include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof. Other materials and constructions can be used. The disclosed web 100 can be rolled on a hollow tube, a solid core, or folded in a fan folded box, or in another desired form for storage and shipment.

As shown in FIG. 1, the web 100 can include a series of transverse seals 118 disposed along the longitudinal extent of the web 100. Each transverse seal 118 extends from the longitudinal edge 112 towards the inflation channel 114, and in the embodiment shown, toward the first longitudinal edge 110. Each transverse seal 118 has a first end 122 proximate the second longitudinal edge 112 and a second end 124 spaced a transverse dimension d from the first longitudinal edge 110 of the film 110. A chamber 120 is defined within a boundary formed by the longitudinal seal 112 and pair of adjacent transverse seals 118.

Each transverse seal 118 embodied in FIG. 1 is substantially straight and extends substantially perpendicular to the second longitudinal edge 112. It is appreciated, however, that other arrangements of the transverse seals 118 are also possible. For example, in some embodiments, the transverse seals 118 have undulating or zigzag patterns.

The transverse seals 118 as well as the sealed longitudinal edges 110,112 can be formed from any of a variety of techniques known to those of ordinary skill in the art. Such techniques include, but are not limited to, adhesion, friction, welding, fusion, heat sealing, laser sealing, and ultrasonic welding.

An inflation region, such as a closed passageway, which can be a longitudinal inflation channel 114, can be provided. The longitudinal inflation channel 114, as shown in FIG. 1, is disposed between the second end 124 of the transverse seals 118 and the first longitudinal edge 110 of the film. Preferably, the longitudinal inflation channel 114 extends longitudinally along the longitudinal side 110 and an inflation opening 116 is disposed on at least one end of the longitudinal inflation channel 114. The longitudinal inflation channel 114 has a transverse width D. In the preferred embodiment, the transverse width D is substantially the same distance as the transverse dimension d between the longitudinal edge 101 and second ends 124. It is appreciated, however, that in other configurations, that other suitable transverse width D sizes can be used.

The second longitudinal edge 112 and transverse seals 118 cooperatively define boundaries of inflatable chambers 120. As shown in FIG. 1, each inflatable chamber 120 is in fluid communication with the longitudinal inflation channel 114 via a mouth 125 opening towards the longitudinal inflation channel 114, thus permitting inflation of the inflatable chambers 120 as further described herein.

In one preferred embodiment, the transverse seals 118 further comprise of notches 128 that extend toward the inflatable chambers 120. As shown in FIG. 1, opposing notches 128 are aligned longitudinally along adjacent pairs of transverse seals 118 to define a plurality of chamber portions 130 within the inflatable chambers 120. The notches 118 create bendable lines that allow for a more flexible web 100 that can be easily bent or folded. Such flexibility allows for the film 100 to wrap around regular and irregular shaped objects. The chamber portions 130 are in fluid communication with adjacent chamber portions 130 as well as with the inflation channel 114.

A series of lines of weaknesses 126 is disposed along the longitudinal extent of the film and extends transversely across the first and second web layers of the film 100. Each transverse line of weakness 126 extends from the second longitudinal edge 112 and towards the first longitudinal edge 110. Each transverse lines of weakness 126 in the web 100 is disposed between a pair of adjacent chambers 120. Preferably, each line of weakness 126 is disposed between two adjacent transverse seals 118 and between two adjacent chambers 120, as depicted in FIG. 1. The transverse lines of weakness 126 facilitate separation of adjacent inflatable cushions 120.

The transverse lines of weakness 126 can include a variety of lines of weakness known by those of ordinary skill in the art. For example, in some embodiments, the transverse lines of weakness 126 include rows of perforations, in which a row of perforations includes alternating lands and slits spaced along the transverse extent of the row. The lands and slits can occur at regular or irregular intervals along the transverse extent of the row. Alternatively, for example, in some embodiments, the transverse lines of weakness 126 include score lines or the like formed in the web material.

The transverse lines of weakness 126 can be formed from a variety of techniques known to those of ordinary skill in the art. Such techniques include, but are not limited to, cutting (e.g., techniques that use a cutting or toothed element, such as a bar, blade, block, roller, wheel, or the like) and/or scoring (e.g., techniques that reduce the strength or thickness of material in the first and second web layers, such as electro magnetic (e.g., laser) scoring and mechanical scoring).

Preferably, the transverse width 129 of the inflatable chamber 120 is 3" up to about 40", more preferably about 6" up to about 30" wide, and most preferably about 12". The longitudinal length 127 between weakened areas 126 can be at least about 2" up to about 30", more preferably at least about 5" up to about 20", and most preferably at least about 6" up to about 10". In addition, the inflated heights of each inflated chamber 120 can be at least about 1" up to about 3", and most preferably about 6". It is appreciated that other suitable dimensions can be used.

Figure 2:
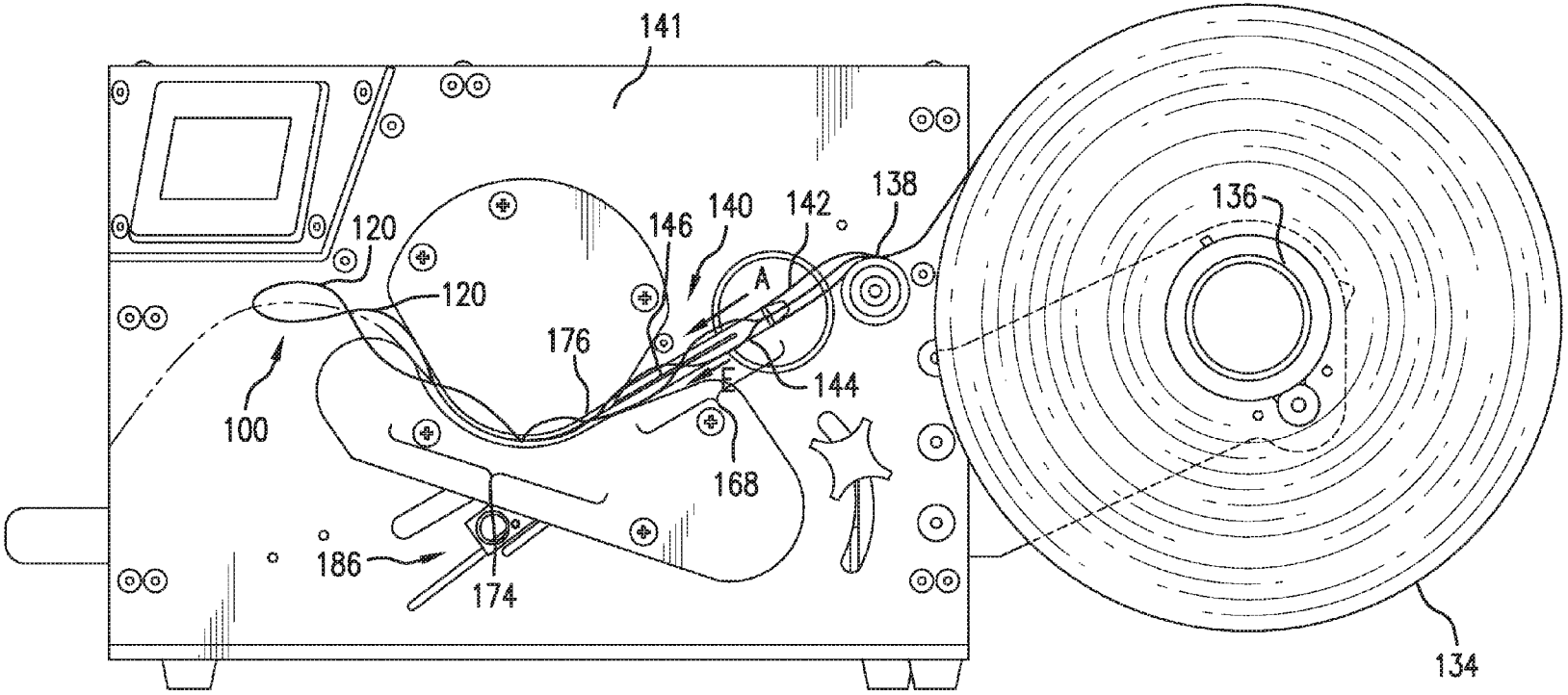
FIG. 2 is side view of the inflation and sealing assembly in accordance with the present disclosure.

Turning now to FIG. 2, an inflation and sealing assembly 132 for converting the web 100 of uninflated material into a series of inflated pillows or cushions 120 is provided. As shown in FIG. 2, the uninflated web 100 can be a roll of material 134 provided on a roll axle 136. The roll axle 136 accommodates the center of the roll of web material 134. Alternative structures can be used to support the roll, such as a tray or multiple rollers.

The web 100 is pulled by a drive mechanism over an optional dancer roller 138 that extending generally perpendicularly from a housing 141. The dancer roller 138 guides the web 100 away from the roll of material 134 and steadily along a material path "B" along which the material is processed in a longitudinal direction "A". Preferably the dancer roller 138 prevents the material 134 from sagging between the inflation nozzle 140 and roll 134. To prevent or inhibit bunching up of the web material 100 as it is unwound from the roll 134, the roll axle 136 can be provided with a brake to prevent or inhibit free unwinding of the roll 134 and to assure that the roll 134 is unwound at a steady and controlled rate. According to one embodiment, a spring-loaded leather strap can be used as a drag brake on the roll axle 136.

Preferably, the inflation and sealing assembly is configured for continuous inflation of the web 100 as it is unraveled from the roll 134. The roll 134, preferably, comprises a plurality of chain of chambers 120 that are arranged in series. To begin manufacturing the inflated pillows from the web material 100, the inflation opening 116 of the web 100 is inserted around an inflation assembly, such as an inflation nozzle 140, and is advanced along the material path "E". In the embodiment shown in FIG. 2, preferably, the web 100 is advanced over the inflation nozzle 140 with the chambers 120 extending transversely with respect to the inflation nozzle 140 and side outlets 146. The side outlets 146 direct fluid in a transverse direction with respect to the nozzle body 144 into the chambers 120 to inflate the chambers 120 as the web 100 advanced along the material path "E" in a longitudinal direction "A". The inflated web 100 is then sealed by the sealing assembly 103 in the sealing area 174 to form a chain of inflated pillows or cushions.

The side inflation area 168 is shown as the portion of the inflation and sealing assembly along the path "E" adjacent the side outlets 146 in which air from the side outlets 146 can inflate the chambers 120. In some embodiments, the inflation area 168 is the area disposed between the inflation tip 142 and entry pinch area 176, described below. Preferably, the web 100 is inserted around the inflation nozzle 140 at the nozzle tip 142, which is preferably disposed at the forward most end of the inflation nozzle 140. The inflation nozzle 140 inserts fluid, such as pressured air, into the uninflated web material through nozzle outlets, inflating the material into inflated pillows or cushions 120. The inflation nozzle 140 can include a nozzle inflation channel therethrough that fluidly connects a fluid source with the nozzle outlets. It is appreciated that in other configurations, the fluid can be other suitable pressured gas, foam, or liquid.

According to an embodiment, the nozzle outlets can include a longitudinal outlet, such as a nozzle tip outlet 148; and a lateral outlet, such as side outlet 146, downstream of the tip outlet 148 and along the longitudinal side of the nozzle wall of the nozzle body 144 of the inflation nozzle 140. Preferably, the nozzle tip outlet 146 is at the upstream-most tip 142 of the nozzle 140 with respect to the material flow direction along the path A, at the distal end of the inflation nozzle 140. Preferably, the side outlet 148 is the principal outlet that provides the primary fluid source for inflating the chambers 120, and the nozzle tip outlet 148 operates to stabilize the advancing web 100 as it approaches the inflation nozzle 140. It is appreciated that the fluid expelled from the nozzle tip outlet 148 can also help inflate the chambers 120.

Figure 3:
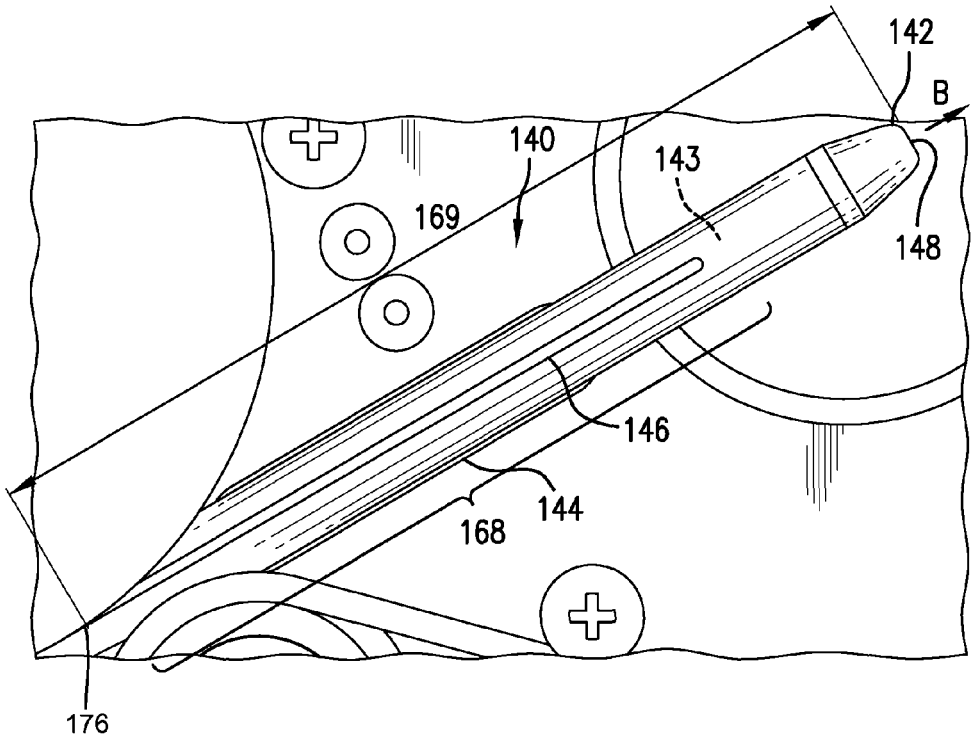
FIG. 3 is a partial view of the inflation nozzle in accordance with the present disclosure.

FIG. 3 illustrates an enlarged view of a portion of the exemplary nozzle 140 in the preferred embodiment. As shown in FIG. 3, the side outlet 146 can extend longitudinally along the nozzle body 144 toward a longitudinal distance from the inflation tip 142. In the preferred embodiment, the side outlet 146 originates proximate, or in some configurations, overlapping, the sealer assembly such that the side outlet 146 continues to inflate the inflatable chambers 120 about right up to the time of sealing. This maximizes the amount of fluid inserted into the inflatable chambers 120 before sealing, and minimizes the amount of dead chambers, i.e, chambers that do not have sufficient amount of air. Although, in other embodiments, the slot outlet 146 can extend downstream past the entry pinch area 176, and portions of the fluid exerted out of the outlet 146 is directed into the web 100.

Preferably, the length of the side outlet 146 is slot having a length that extends a majority of the inflation nozzle 140 at a length 169 between the tip 142 and the entry pinch area 176. By having a side outlet 146 that extends along a majority of the length 169 of the inflation nozzle 140, the side outlet 146 inflate inflation chambers 120 that are advanced through the inflation and sealing assembly 101 at higher speeds without requiring a significant increase of the flow rate of the expelled fluid. Further, the longer side outlet 146 facilitates inflation of webs having a divider, seals, or notches within the chambers 120, such as notches 128 forming chamber portions 130 described herein, which can restrict air flow into the chambers 120. Preferably, the side outlet 146 can have a length that is at least about 30% of the length 169 of the inflation nozzle 140, more preferably at least about 50% of the length 169 of the inflation nozzle 140, or in some embodiments at least about 80% of the length 169 of the inflation nozzle 140. The side outlet 146 expels fluid out the lateral side of the nozzle body 144 or in a transverse direction with respect to the inflation nozzle 140 through the mouth 125 of each of the chambers 120 to inflate the chambers 120 and chamber portions 130. Preferably, a portion of the side of the nozzle is closed behind the downstream tip 142, such as about 10% or 20% or more of the nozzle.

Preferably, the flow rate is about 2 to 15 cfm, with an exemplary embodiment of about 3 to 5 or cfm. The exemplary embodiment is with a blower rated at approximately 14-20 cfm. But much higher blow rates can be used, for example, when a higher flow rate fluid source is used, such as, a blower with a flow rate 1100 cfm.

In some configurations of the side outlet 146, the side outlet 146 comprises a plurality of outlets, such as slots or separate holes, that extend along the nozzle body 144. For example, the side outlet 146 can include a plurality of slots that are aligned in a series extending along the longitudinal side of the nozzle body 144 toward the inflation tip 142, which slots can be aligned parallel to each other, or in various radial directions about the axis of the nozzle body.

The inflation tip 142 includes a nozzle tip outlet 148 that is fluidly connected to the fluid conduit 143 within the nozzle body 144 to expel fluid upstream out of the nozzle tip outlet 148. Preferably, the nozzle body 144 has a longitudinal axis extending along and defining the material path "E", and the tip outlet 148 is aimed from the nozzle body 144 in upstream direction B, generally upstream along the longitudinal axis. In this embodiment, the nozzle body 144 defines the material path "E" laterally adjacent thereto.

In traditional inflation nozzles not including a tip outlet 148, the tip of the inflation nozzle is used to pry open and separate the web layers in an inflation channel at the tip as the material is forced over the tip. For example, when the web is pulled over tradition inflation nozzles, the tip of the traditional inflation nozzles forces the web layers to separate from each other, which can cause unintended puncturing through or breaking of the web layer at higher material speeds or in cases in which a weakened area extends across the inflation channel at higher material speeds or in cases in which a weakened area extends across the inflation channel 144 of the web 100. This creates much of the noise and vibrations during operation of the system and causes elevated wear on the nozzle tip. In the preferred embodiment, the majority of the fluid from the fluid source is expelled from the side outlet 146, but a portion of the fluid is expelled from the nozzle tip outlet 148 to improve the material flow of the web 100 over the nozzle. The portion of the fluid being expelled from the nozzle tip outlet 148 creates a pressurized flow, producing a pressurized column of the fluid upstream of the nozzle 140 that acts as a guide that prealigns the web 100 with the nozzle 140 and separates the layers upstream of and before they reach the nozzle tip 142. As the layers arrive at the tip separated, they do not need to be pried or wedged apart by the tip 142, which reduces noise and vibration caused in traditional inflation nozzles.

Figure 4:
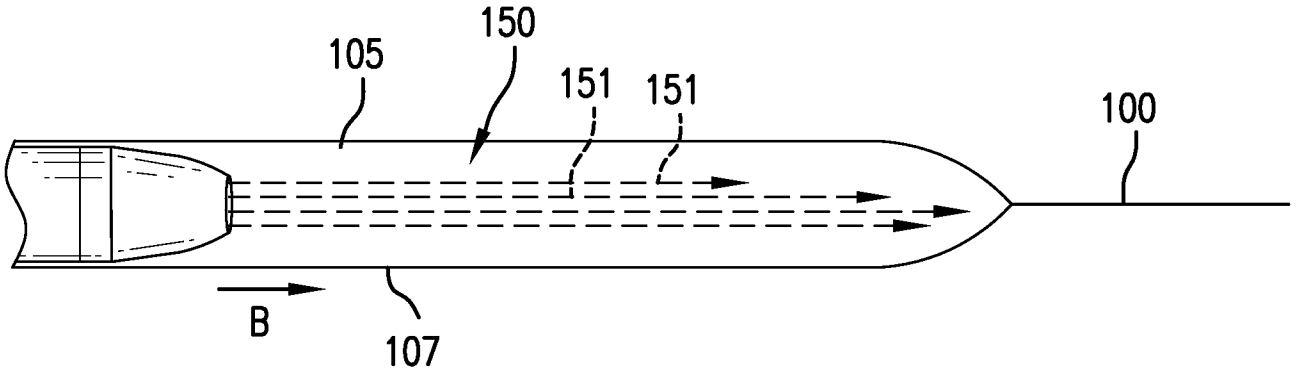
FIG. 4 is a partial side view of the web and nozzle tip.

FIG. 4 depicts a side view of the nozzle 140 expelling fluid 151 from the nozzle tip outlet 148 into the inflation channel 116 of the web 100. As illustrated in FIG. 4, the fluid 151 being expelled from the nozzle tip outlet 148 forms the expanded, fluid-pressurized column 150 that separates the first web layer 105 and second web layer 107 and also acts as a guide to guide the web 100 over the inflation nozzle 140. This facilitates the inflation channel 114 of the web 100 to easily slide over the inflation nozzle 140, which allows for faster inflation of the web 100 because the web 100 can be pulled over inflation nozzle 140 quicker with less resistance. Further, expelling fluid out of the tip outlet 148 increases the life of the nozzle tip 142. While the tip outlet 148 is sufficiently aligned with the nozzle axis to achieve the above effects. In some configurations, the tip outlet 148 is parallel to, and preferably also coaxial with the nozzle body axis and the path "E", so that fluid direction "B" is also parallel and coaxial with the nozzle body and path "E". In some configurations, the fluid-pressurized column 150 aligns with the material 19 ahead of the nozzle 140. In other embodiments, however, the fluid 151 can be expelled at an angle to the nozzle body axis, such as up to about 5°, 10°, 15°, or in some cases about 20° degrees with respect to the longitudinal axis of the nozzle body.

Preferably, the diameter 149 of the tip outlet 142 and amount of fluid expelled from the tip outlet 142 are sufficient to expel a pressurized flow sufficient to push and separate the first and second web layers 105,107 from each other to facilitate sliding the web over the inflation nozzle 140. Preferably, the tip outlet 148 and side outlet 146 are sized relatively to each other such that the fluid is expelled from the tip outlet 148 at a lesser rate than from the side outlet 146. In the preferred embodiment, the flow rate from the nozzle outlets is proportional to the area of the nozzle outlet. Preferably, the flow rate or area of the nozzle tip outlet 148 is at least about 10% to up to about 40% or 45% of the total flow rate or area, and the flow rate or area of the side outlet 146 is about at least 90% to up to about 60% of the total flow rate or area. More preferably, the flow rate or area of the nozzle tip outlet 148 is about 20% of the total flow rate or area, and the flow rate or area of the side outlet 146 is about 80% of the total flow rate or area. The flow rate or area of the nozzle tip outlet 148 in some embodiments is less than about 80% of that of the side outlet 146, and in some embodiments less than about 50% or 30%, and preferably at least about 10% or 20% thereof. In an exemplary embodiment, the flow rate or area of the nozzle top outlet 148 is about 25% of that of the side outlet 146. Preferably, the tip outlet 148 in one embodiment has a diameter that is about at least 1/16 inch to about at most 1/8 inch in typical air-inflation and sealing machines, but other diameters can be used depending on the fluids and flow rates desired.

While the tip outlet 148 has a single tip opening, alternatively, the nozzle tip outlet 148 can include a plurality of openings about the inflation tip 142. The openings can be aligned circumferentially or diametrically around the inflation tip 142, or in configurations, the openings can be spaced around the inflation tip 142 and disposed such that it expels fluid at an angle with respect to the fluid direction "B". Where multiple tip openings are used, they preferably all aim generally upstream as described above, although in some embodiments additional openings at the tip are provided that aim at other angles.

Figure 5:
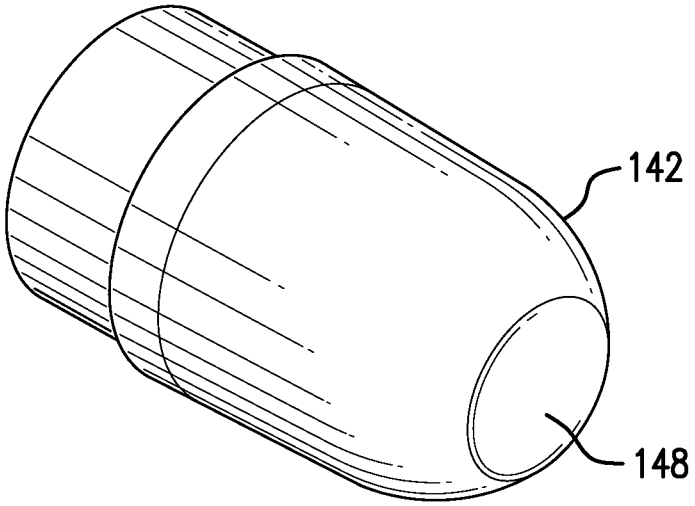
FIG. 5 is a view of an embodiment of the nozzle tip.
Figure 6:
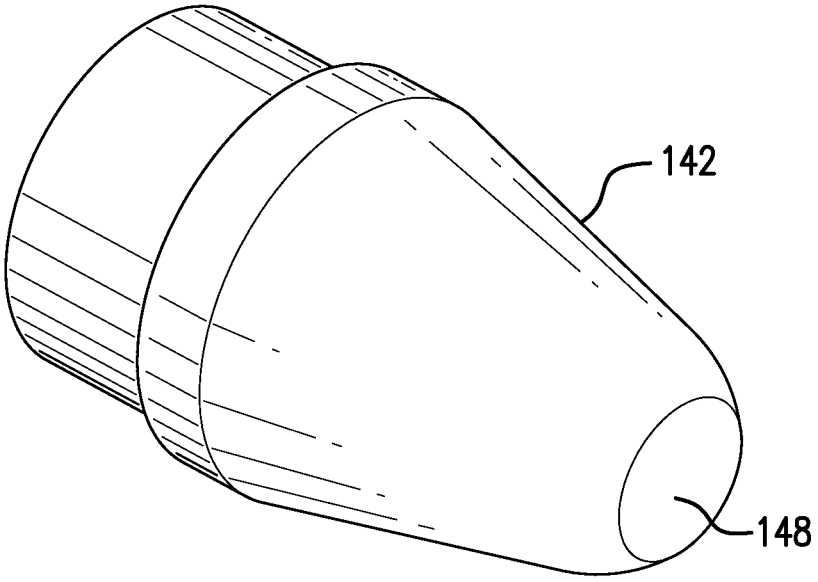
FIG. 6 is a view of another embodiment of the nozzle tip.

FIG. 5 illustrates one embodiment of the inflation tip 142. The inflation tip 142 can have a conical shape with a tapered end extending upstream the assembly. FIG. 6 illustrates another embodiment of the inflation tip 142 in which the inflation tip 142 has a conical shape with a blunted tapered end. In both the exemplary inflation tip 142 illustrated in FIGS. 5 and 6, the tapered end of the inflation tip 142 facilitates the easy sliding of the inflation channel 114 over the inflation nozzle 140 in addition to the fluid 150 being expelled from the tip outlet 148.

In the preferred embodiment, the inflation nozzle 140 is provided an angle θ with respect to the horizontal plane 152. In the embodiment shown, the inflation nozzle 140 is angled such that it aligns material path "E" of the sealing assembly to approach the nozzle 140 in a downward, slanted angle θ. Preferably, the angle θ can be horizontal or angled so the path approaches in an upward direction, but angle θ preferably at least about 5° or 10° upwards from the horizontal in an upstream direction, typically to up to about 30°, 45°, or 60° with respect to the horizontal plane 152. The inflation nozzle 140 and its longitudinal azis are typically aligned tangentially to the sealing drum 154. The angled inflation nozzle facilitates for easy loading of the web 100 from the roll 134 onto the inflation nozzle 140 when the inflation and sealing device is located below eye level, such as on a table top.

Figure 7:
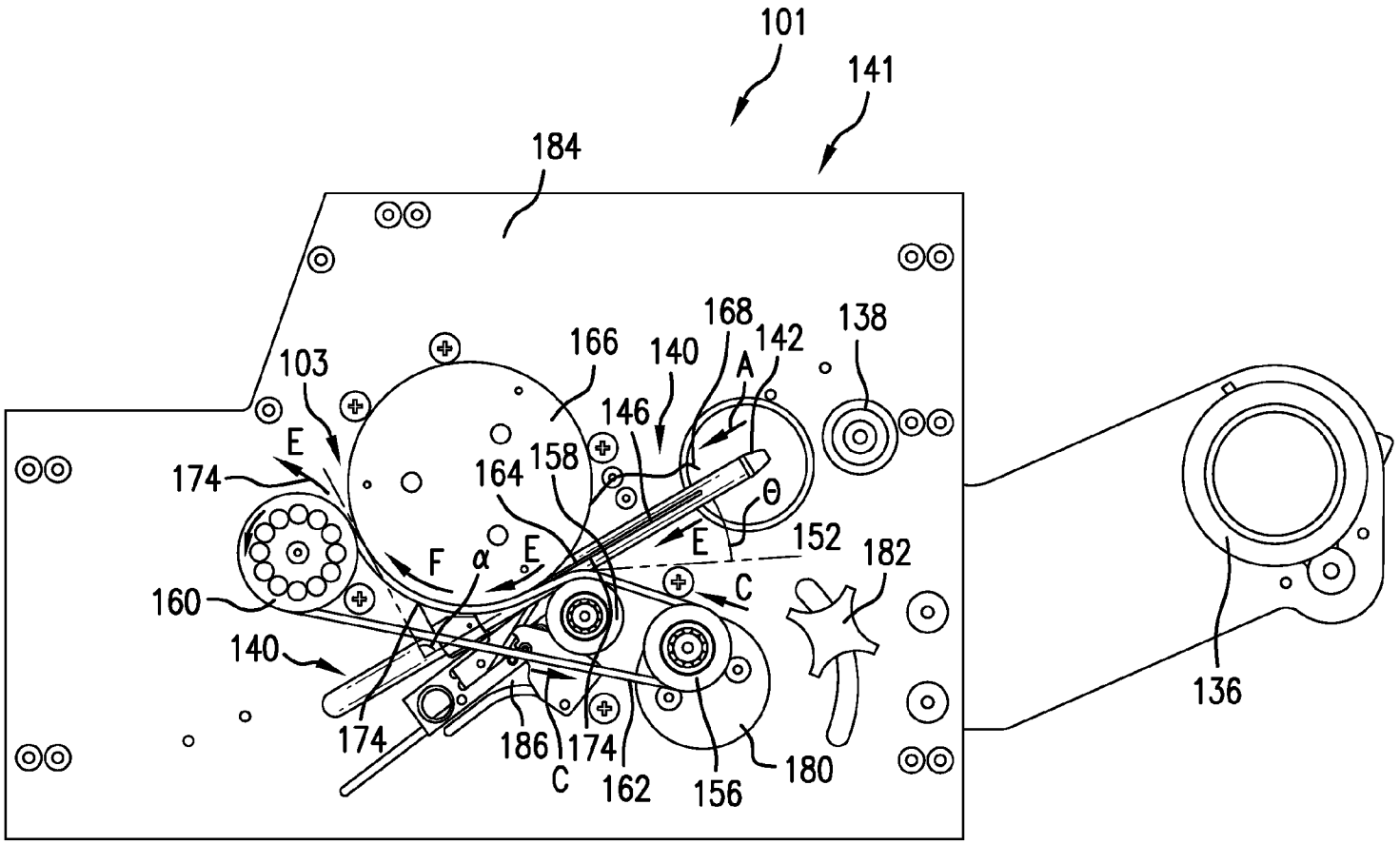
FIG. 7 is a side view of the inflation and sealing assembly of FIG. 2.

FIG. 7 illustrates a side view of the preferred inflation and sealing assembly 101. As shown, the fluid source can be disposed behind a housing plate 184 or other structural support for the nozzle and sealing assemblies, and preferably behind the inflation nozzle 140. The fluid source is connected to and feeds the fluid inflation nozzle conduit 143. The web 100 is fed over the inflation nozzle 140, which directs the web to the inflation and sealing assembly 101. The web 100 is advanced or driven through the inflation and sealing assembly by a drive mechanism, such as by a driver or sealing drum 166 or the drive roller 160, in a downstream direction along a material path "E".

When viewed from the top, in FIG. 7, facing one of the principal surfaces of the upper film layer, in a transverse direction extending between the drum 17 and the belt 162, the sealing assembly 103 is positioned transversely between the nozzle and the chambers being inflated to seal across each of the transverse seals. Some embodiment can have a central inflation channel, in which case a second sealing assembly and inflation outlet may be provided on the opposite side of the nozzle. Other known placement of the web and lateral positioning of the inflation nozzle and sealing assembly can be used.

Preferably, the sealing assembly is attached to the housing plate 184. The sealing assembly 103 includes a traction member, such as a belt 162, which is wrapped along rotating members, such as rollers. In the preferred configuration, a single belt 162 is wrapped around a tension roller 156, pinch roller 158, and a drive roller 160, although in other embodiments, more than one belt can be used. After inflation, the web 100 is advanced along the material path "E" towards a web feed area 164 where it enters the sealing assembly 103. The web feed area 164 is disposed between the pinch roller 158 and the drum 166. The web feed area 164 can include an entry pinch area 176. The entry pinch area 176 is the region in which the first and second web layers 105,107 are pressed together or pinched to prevent fluid from escaping the chambers 120 and to facilitate sealing by the sealing assembly 103. Preferably, the pinch area 176 is the area between the sealing drum 166 and the portion of the belt 162 downstream the pinch roller 158. The belt 162 at the entry pinch area 176 has sufficient tension to tightly pinch or press the web layers 105,107 together against the drum 17. The tension of the belt 162 will be described in further detail below. In other configurations, the pinch area 164 can be disposed between the pinch roller 158 and sealing drum 166.

The belt 162 is driven in a drive path or direction shown by arrow "C" in FIG. 7 by the rollers. In the preferred embodiment, the drive roller 160 is associated or connected with a drive mechanism that rotates the drive roller 160 in direction "D" to move the belt 162 along the drive path "C" and advance the web 100. Preferably, the drive mechanism is connected to a motor located within the housing 141. The drive mechanism can include gears or the like located behind the housing 141 to transfer the power from the motor to the drive roller 160. Preferably, the tension roller 156 and pinch roller 158 are free spinning, and rotate in response to belt 162 being moved by the rotation of the drive roller 160. It is appreciated, however, that in other configurations, the tension roller 156 and/or pinch roller 158 can be associated or connected with the drive mechanism to independently rotate or to act as the drive roller 160 to drive the belt 162 along the drive path "C". In other embodiments, multiple cooperating belts can be used against the opposed layers, or rollers can directly guide and operate on the layers past rotating or stationary heaters or other sealing members.

After being fed through the web feed area 164, the first and second web layers 105,107 are sealed together by a sealing assembly 103 and exit the sealing drum 16. In the preferred embodiment, the sealing assembly 103 includes a sealing drum 166. The sealing drum 166 includes heating elements, such as thermocouples, which melt, fuse, join, bind, or unite together the two web layers 105,107, or other types of welding or sealing elements.

Preferably, the web 100 is continuously advanced through the sealing assembly 103 along the material path "E" and past the sealing drum 166 at a sealing area 174 to form a continuous longitudinal seal 170 along the web by sealing the first and second web layers 105,107 together, and exits the sealing area 174 at an exit pinch area 178. The exit pinch area 178 is the area disposed downstream the entry pinch area 164 between the belt 162 and the sealing drum 166, as shown in FIG. 7. The sealing area 174 is the area between the entry pinch area 164 and exit pinch area 178 in which the web 100 is being sealed by the sealing drum 166. The longitudinal seal 170 is shown as the phantom line in FIG. 1. Preferably, the longitudinal seal 170 is disposed a transverse distance from the first longitudinal edge 102,106, and most preferably the longitudinal seal 170 is disposed along the mouths 125 of each of the chambers 120.

In the preferred embodiment, the sealing drum 166 and belt 162 cooperatively press or pinch the first and second web layers 105,107 at the sealing area 174 against the sealing drum 166 to seal the two layers together. The sealing assembly 103 relies on the tension of the belt 162 against the sealing drum 166, and not an abutting roller, to sufficiently press or pinch the web layers 105,107 therebetween. The flexible resilient material of the belt 162 in the preferred embodiment, allows for the tension of the belt 162 to be well-controlled by the positions of the rollers, which will be described in further detail below. For example, the tension roller 156 and drive roller 160 cooperatively pull the belt 162 in opposing direction creating tension in the belt 162. Such configuration of the sealing drum 166 and belt 162 also requires less belt 162 material than traditional inflation and sealing assemblies because it relies on the sealing drum 166 and belt 162 to cooperatively pinch or press that web 100 together and not two belts, which can be found in traditional inflation and sealing assemblies.

Preferably, as shown in FIG. 7, the sealing drum 166 is arranged above the belt 162. The drive roller 160 is preferably positioned downstream the feed roller 158 and tension roller 156 with the sealing drum 166 therebetween. The sealing drum 166 is disposed such that a portion of the sealing drum 166 vertically overlaps the feed roller 158, tension roller 156, and drive roller 160 so that the belt 162 is deformed at the sealing area 174 to have a generally U-configuration. Such configuration increases the tension of the belt 162 at the sealing area 174, and facilitates the pinching of the web 100 between the sealing drum 177 and the belt 162 at the sealing area 174. The sealing assembly 103 configuration described also reduces the amount of contact of the web 100 during sealing, which reduces bending of the inflated web. As shown in FIG. 7, the contact area is the sealing area 174 between the entering pinch area 164 and exiting pinch area 174.

In the embodiment shown, the web 100 enters the sealing assembly 104 at the entry pinch area 176 at a sloping downward angle with respect to the horizontal. Additionally, the web 100 exits the sealing assembly 104 at an angle sloped upward with the respect to the horizontal so that the web 100 is exiting facing upwards toward the user. By having the intake and outtake sloped as described herein, the inflation and sealing assembly 101 allows for easy loading and extracting of the web as well as easy access to the web. Thus, the inflation and sealing assembly 103 can be positioned below eye level, such as on a table top, without the need of a high stand. The sloping downward intake and sloping upward outtake of the web 100 from the sealing assembly 103 provides for the material path "E" to be bent at an angle $\alpha$ between the entry pinch area 176 and the exit pinch area 174 (the entry pinch area 176 and exit pinch area 174 are further described below). The angle $\alpha$ between the entry pinch area 176 and exit pinch area 174 is preferably at least about 40 degrees up to at most about 180 degrees. More preferably, the angle $\alpha$ at least about 70 degrees up to at most about 130 degrees. Most preferably the angle $\alpha$ is about 90 degrees.

In the preferred embodiment, the tension roller 156 is moveable between a tense and released position. In the tense position, as shown in FIG. 7, the tension roller 156 is positioned such that it is pulling the belt 162 in a direction opposed or away from the driving roller 160 to create tension in the belt 162 in the sealing area 174. In the released position, the tension roller 156 moves generally downward to release the tension of the belt 162 and loosens the pinching of the web 100 between the sealing drum 166 and belt 162. This allows for a user to easily remove the web or clear up or fix jams within the machine. The movement of the tension roller 156 is controlled by a plate 180 that is associated with a knob 182. In the preferred embodiment, when the knob 182 is moved generally downward by the user, the plate 180 causes the tension roller 156 to move from the tense position to the released position. Similarly, when the knob 182 is moved generally upward by the user, the plate 180 causes the tension roller 156 to move from the released position to the tense position. In other configurations, the knob 182 can be configured to move the tension roller 156 by twisting, turning, or pulling and pressing the knob 182.

Preferably, the sealing drum 166 rotates in a direction "F". The sealing drum 166 is preferably associated with or connected to a drive mechanism, such as a motor or the same drive mechanism associated with the drive roller 160, that causes the drum to rotate. In other configurations, the sealing drum 166 is caused to rotate in response to the advancing web 100 and belt 162.

Figure 8:
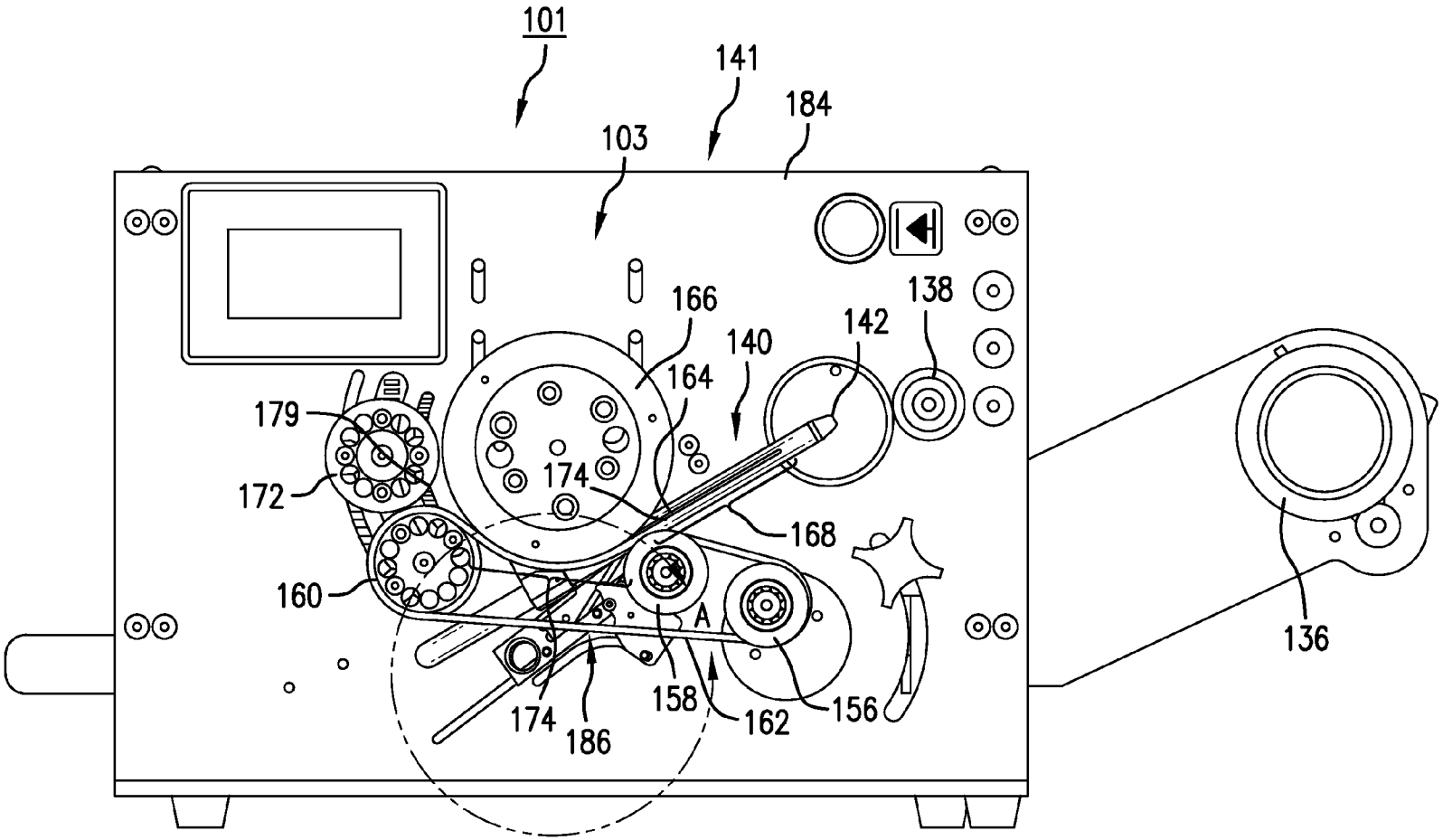
FIG. 8 is a side view of an embodiment of the inflation and sealing assembly.

Alternatively, as shown in another embodiment of the inflation and sealing assembly in FIG. 8, the sealing assembly 103 can include a cooling roller 172. The cooing roller 172 can be disposed directly above the drive roller 160. Preferably, the two rollers 160,172 pinch or press the web 100 so that the belt 162 associated with the drive roller 160 abuts the surface of the cooling roller 172. Such configuration provides for a cooling region 179 disposed between two rollers 160,172 and the exit pinch area 178 to assist with cooling the longitudinal seal 170 immediately after sealing. In the embodiment shown, the surface on one side of the web 100 is exposed and the surface on the opposite side of the web 100 touches the belt 162.

In the embodiment shown, the inflation and sealing device 101 further includes a cutting assembly 186 to cut the web. Preferably, the cutting assembly 186 cuts the first and second web layers 105,107 between the first longitudinal edge 102 and mouth 125 of the chambers. In some configurations, the cutting assembly 186 cuts the web 100 to cut open the inflation channel 114 of the web 100 and remove the first and second layers 105,107 from the inflation nozzle 140.

The cutting assembly 186 can include a cutting device or cutting member, such as a blade 192 with a cutting edge 188, and a cutter holder, such as cutter holder 190, mount, or housing member. Preferably, the cutting member is mounted on a holder 190. Preferably, the cutting member is sufficient to cut the web 100 as it is moved past the edge along the material path "E". In the preferred embodiment, the cutting member is a blade 192 or knife having a sharp cutting edge 188 and a tip 210 at the distal end 196 of the blade 192.

Figure 9:
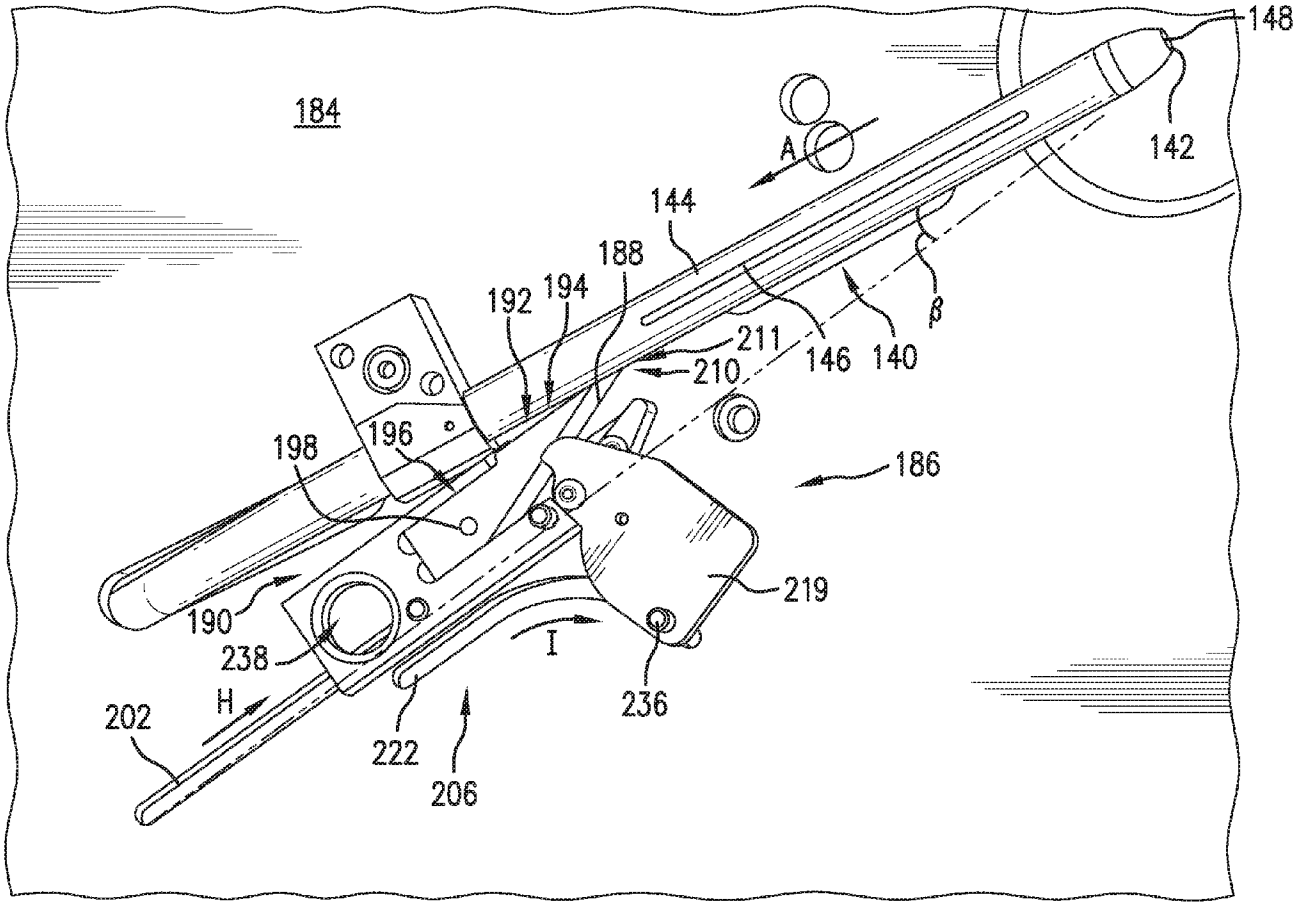
FIG. 9 is a side view of the cutting assembly in an operative position.
Figure 11:
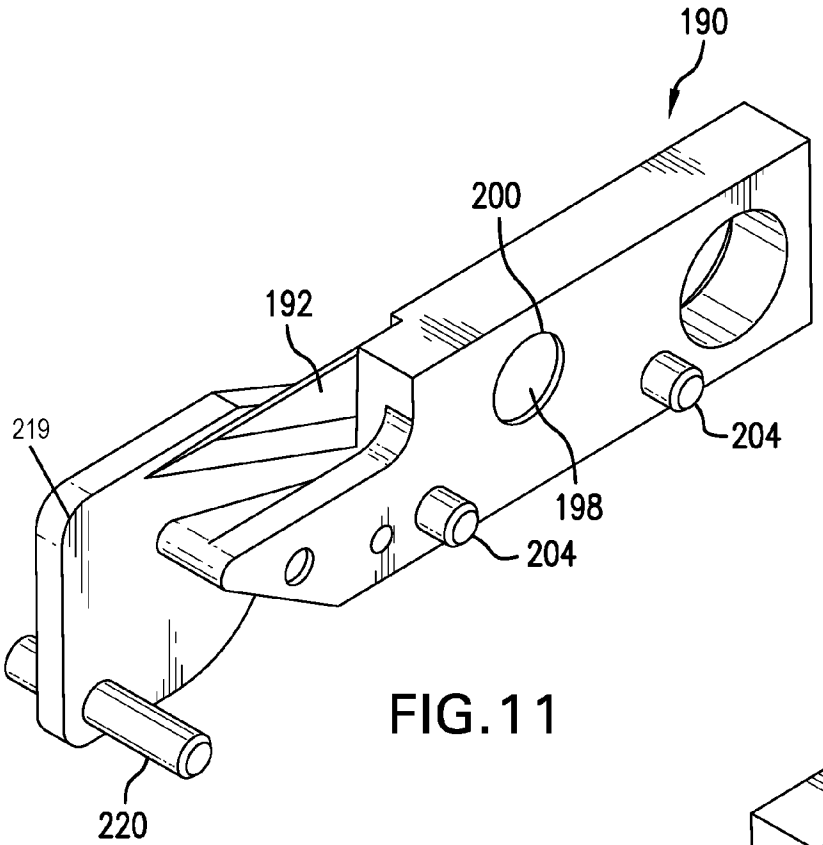
FIG. 11 is a perspective back view of the cutting assembly.
Figure 13:
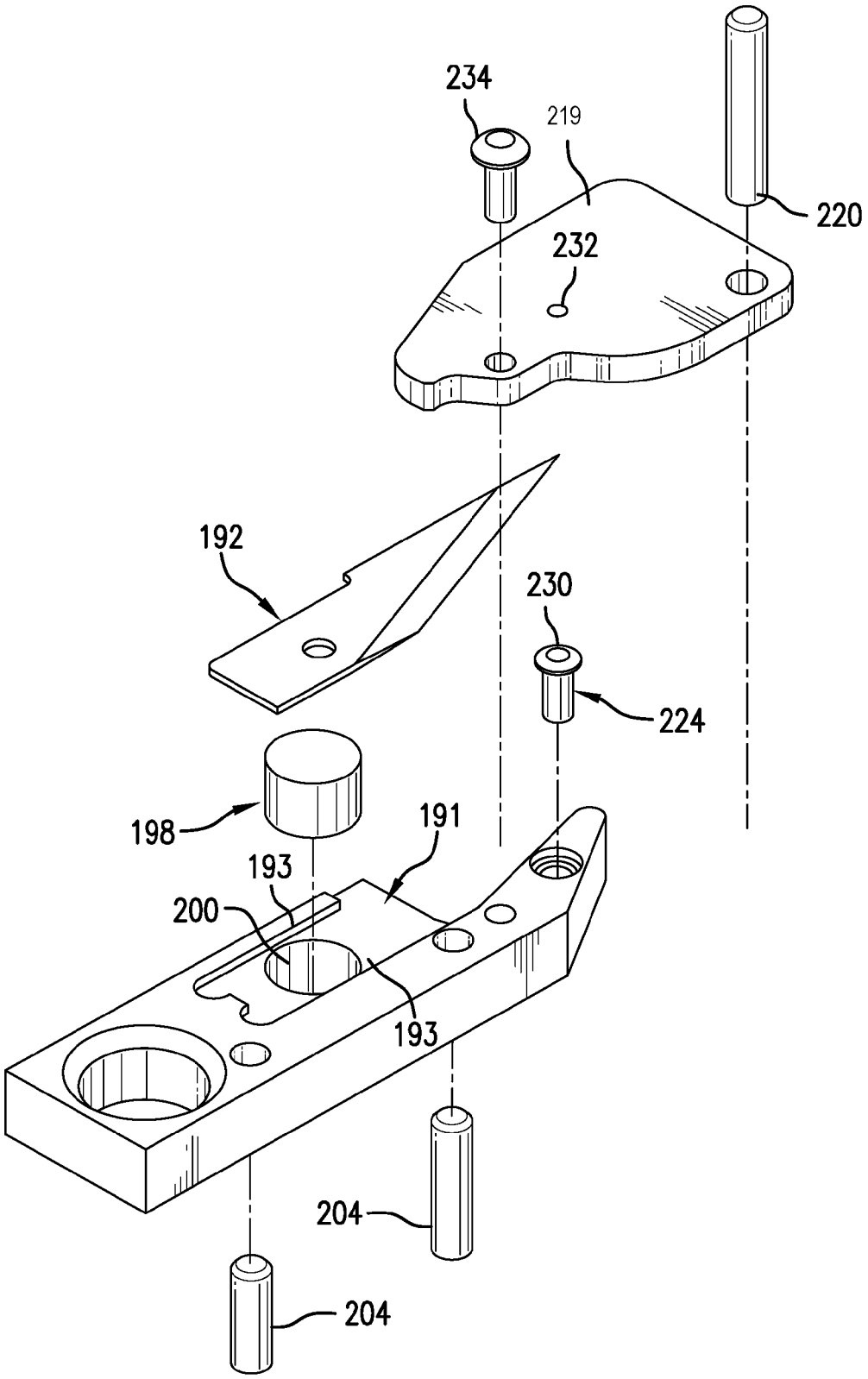
FIG. 13 is a view of a disassembled cutting assembly.

Preferably, as illustrated in FIG. 9, the cutter holder 190 holds the blade 192 magnetically. A magnet 198 preferably attracts the blade 192 or other ferrous material associated with the blade 192 to hold the blade 192 within the cutting holder 190. In the embodiment shown, the magnet 198 is received within a magnetic receiving area 200 (shown in FIG. 11) of the cutting holder 190. Alternatively, the blade 192 can be secured or held within housing 190 by other suitable securing means.

In the preferred embodiment, the cutter holder 190 shuttles the blade 192 along a cutter path "H" from an operative position 206 to an inoperative position 208, and vice versa, such as when a blade 192 is desired to be changed. Preferably the cutter holder 190 is guided by a guide along the cutter path "H", such as via a key and keyway mechanism. In one embodiment, a follower, such as pegs 204, are receivable within a guide track 202 that guides the pegs 204. In some embodiments, the blade is magnetically held directly in the operative position in association with the nozzle without a track, and in others the cutter holder is held magnetically with the blade in the operative position without relying on a track.

In the embodiment shown, track 202 is a recess or slot that is opened on a side transverse to the cutter path "H", such as in the horizontal direction, depending on the orientation of the device. The open side of the track and the straight configuration of the pegs 204 allow the pegs to be removed from or positioned in the track 202 at various locations along the track 202. Preferably the pegs are free from restriction in moving laterally into or out of the track to that the cutter holder 190 is retained in the track by finger pressure alone or gravity, and retained in the operative magnetically. Other embodiments can have elements to retain the cutter holder's 190 engagement in the track.

Preferably, the cutter holder 190 slides along a plane generally parallel to the radius of the drum 17 toward and away from the inflation nozzle 140. Other positions of the cutter path "H" and orientations of the cutter holder 190 can be used.

In the embodiment shown, the track 202 extends between the operative position 206 and inoperative positions 208 to guide the blade 192 toward and away from the inflation nozzle 140. The track 202 is preferably vertically below the inflation nozzle 140 and extends upstream and in an upward slope towards inflation nozzle 140. In other embodiments, the track can be placed above the nozzle and angled down towards it, for example, or angled downstream towards the operative position 206. Preferably, the track 202 is at a sufficient angle β towards the nozzle to align and insert the tip of the blade 192 into a corresponding slot 211 in the nozzle 140 to obtain the desired positioning and angle of the blade 192 with respect to the nozzle 140 in the operative position during operation. The track 202 angle β with respect to the inflation nozzle 140 is typically about between 5° and about 45° or higher.

In the embodiment shown, a support member 184 such as a vertical supportive wall or other suitable structure or housing, can be provided that supports the inflation assembly 109. In such embodiment, the track 202 can be provided as a recess or slot cut or otherwise formed in the wall 184. While the cutter holder 190 has a pair of pegs 204 receivable in the track 202 in this embodiment to maintain the desired angle of the blade 192 with respect to the nozzle 140 other numbers of pegs or other followers, such as a rectangular protrusion, can be used. The pegs 204 are disposed on the backside of the cutter holder 190, facing laterally, and in this embodiment generally horizontally, towards the support member 184 wall and into mating position with the track 202. In other embodiments, the track and follower can be reversed, such as by providing a slot on the cutter holder 190 and a raised rail received in the slot on the support member 184.

To move the shuttle 190 along the track 202 from the operative position 206 to the inoperative position 208, slight pressure is applied against the cutter holder 190 in a transverse direction, such as against the support member 184 wall, such as by a user's finger, as the cutter holder 190 is moved along the cutter path "H" in the track 202.

Figure 10:
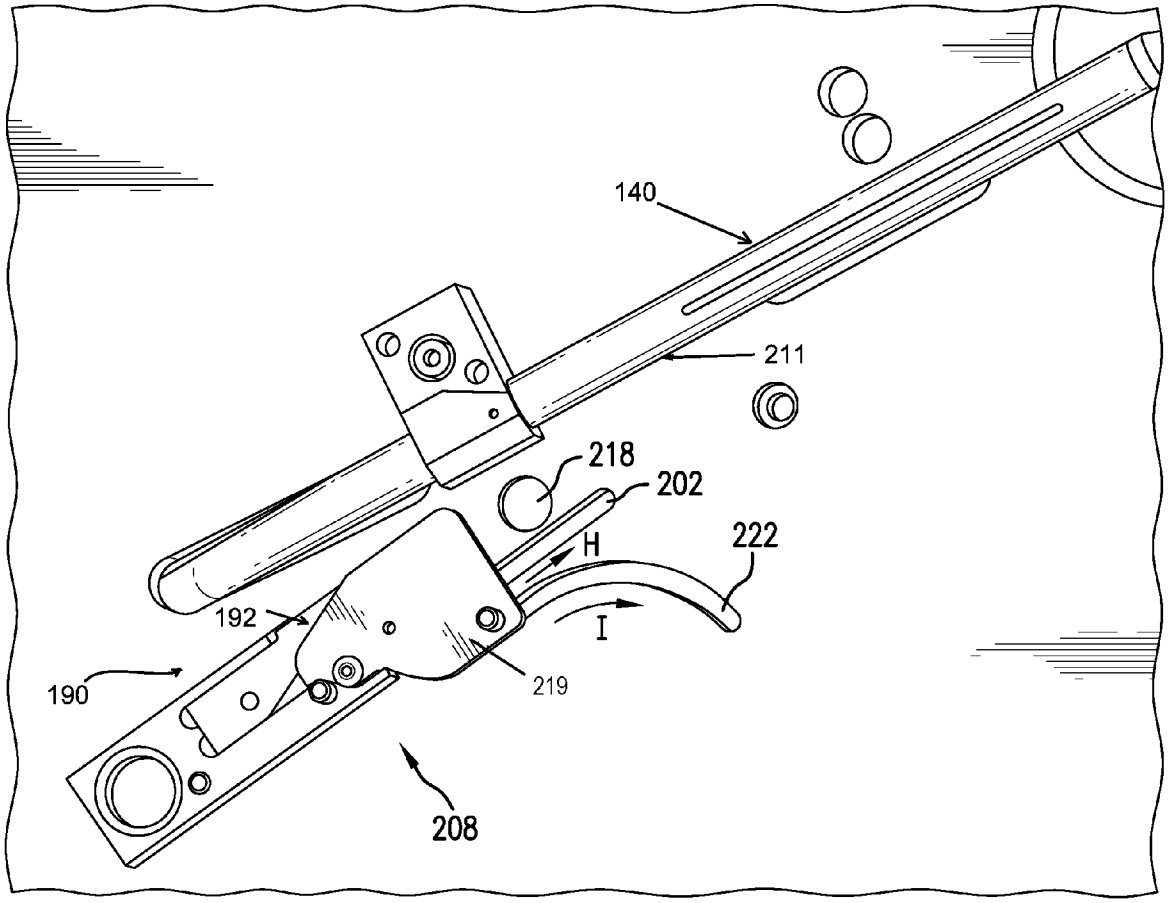
FIG. 10 is a side view of the cutting assembly in an inoperative position.
Figure 12:
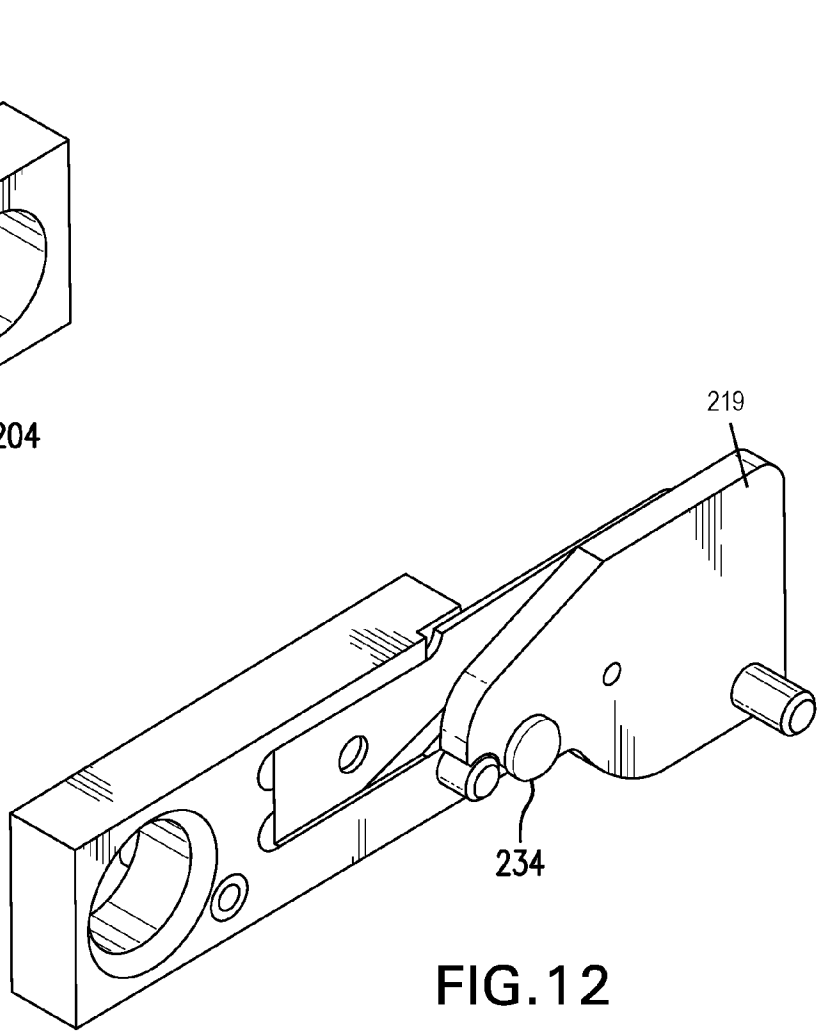
FIG. 12 is a perspective front view of the cutting assembly.

FIG. 10 illustrates the blade 192 in an inoperative position 208. Preferably, in the inoperative position 206, the blade 192 is spaced away from the inflation nozzle 140 and the slot 211. In the inoperative position 208, the cutter holder 190 is easily removed from the track 202 and is out of magnetic engagement with magnet 218. In this embodiment, the cutter holder 190 can easily fall out of or be pulled out of the track 202 when no pressure is being applied against it. This provides for easy and safe replacement of the shuttle 190 and blade 192. The user can easily replace the cutter holder 190 having the blade 192 with a new cutter holder 190 having a new blade 192 instead of having to touch the blade 192. Additionally, the cutter holder 190 can be manufactured with the blade 192 already loaded and sold separately from the inflation and sealing assembly 103.

Preferably, in the operative position 206, the blade 192 is positioned adjacent the inflation assembly to cut the web passing over the inflation assembly. The blade 192 remains stationary with respect to the inflation nozzle 140 to cut open the inflation channel 114 of the web 100 as it is moved along the material path "E". In the embodiment shown in FIG. 9, the blade 192 is partially received in the nozzle body 144 in the operative position 206. As shown, the blade 192 penetrates and protrudes from the nozzle body 144. Preferably, the tip 210 of the blade 192 is received in the nozzle body 144 in the operative position 206. In the preferred embodiment, the blade 192 is in the operative position 206 during operation of the inflation and sealing assembly 103. In the embodiment shown, the blade 192 is positioned adjacent the entry pinch area 174 so that the blade 192 can cut or slice the web right before or during sealing of the web 100, but other positions of the blade with respect to the material path "E" can be used.

In the embodiment shown, the cutter holder 190 is magnetically held in an operative position 206 without requiring additional pressure against it by a user. In one embodiment, the cutter holder is held mechanically by a snap or other device in the operative position 206. Preferably, the magnet 198 is magnetically influenced, such as by magnetic attraction, to magnet 218 adjacent the track, such as on the support member wall 184 for holding the cutter holder 190 adjacent the inflation assembly 109 in the operative position 206. Preferably, the blade 192 is magnetically influenced, such as by magnetic attraction, to the magnet 198, to be retained magnetically on the cutter holder 190. In some embodiments, the magnets can be permanent magnets or an electromagnetic element that creates a magnetic field when powered, for example. In some embodiments, some of all of the magnets are replaced with mechanical latches or the like, and in others the structure employs magnetic repulsion to hold the blade and cutter holder in the operative position. In some embodiments, one of the magnets 198 or 216 is replaced by a ferrous element that is magnetically attracted to the magnet, for instance, and the track itself is preferably non-magnetic to naturally release the cutter holder 190 and blade 190.

The cutter assembly 186 can further include a cutting member cover, such as a door 219. The door 219 is preferably positioned adjacent the proximal end 194 of the cutter holder 190. In the operative position 206, the door is open to expose the cutting edge 188 and/or tip 210 of the blade 192 and closed to cover the cutting edge 210 and/or tip 210 of the blade 192 in the inoperative position 208. The closed door can protect against injury during handling and removing the cutter holder 190. The closed door 219 is moveable about the cutter holder 190 body. In the embodiment shown, the door 219 is pivotable about a door pivot 234, or is otherwise movably mounted to the body of the cutter holder 190.

Preferably, the door automatically opens to expose the blade 192 when the blade 192 is moved to the operative position 206 and automatically closes when the cutter holder is moved out of the operative position 206, although in some embodiments, opening and/or closing of the door can be accomplished manually. In the embodiment shown, a pivotal side of the door 219 is guided or moved along a door path "I" from the operative position 206 to the inoperative position 208, and vice versa. The door path "I" preferably diverges from the inflation nozzle 140 towards the operative position 206 so that as the cutter holder 190 body is moved toward the inflation nozzle 140 along the cutter path "H", the door 219 is directed away from the inflation nozzle 140 to expose the blade 192. Preferably, the door 219 is guided on a guide along the door path "H" via a key and keyway mechanism, in which a follower, such as a peg 220, is receivable within a guide, such as a track 222. In the embodiment shown, the track 222 is a recess or slot similar to the track 202 along the cutter path "H". The alternative arrangements of the guide and follower described with respect to the cutter holder 190 above are also applicable to changes that are foreseen with respect to the door. Additionally, in some embodiments, the door can be positioned to move linearly or otherwise uncover the blade.

The door 219 is preferably held in the closed position by a holding mechanism, such as a spring plunger 224 mechanism, that is sufficient to keep the door in a closed position while also allowing the door 219 to be opened when the cutter holder 190 is moved along the cutting path "H", or by a latch, a magnet, or other device. In the embodiment shown, the spring plunger 224 cooperates with a spring 226 within a spring receiving area 228 in the cutter holder 190. The spring plunger 224 also includes a protruded portion 230 that sufficiently protrudes from the surface of the spring plunger 224 adjacent the door 219. When door 218 is in a closed position, i.e., the tip 210 of the blade 192 is covered, the door 219 presses the spring plunger 224 into the spring receiving area 228 and the spring 226 pushes the spring plunger 224 and protruded portion 230 against the door 219. In the closed position, the protruded portion 230 is preferably received in a receiving area 232 so that in the closed position, the spring 226 pushes the protruded portion 230 into the receiving area 232 and effectively holding the door 219 in a closed position. It is appreciated that other suitable mechanisms can be used to effectively keep the door 219 in the closed position while also allowing the door 218 opened when the cutter holder 190 is moved along the cutting path "H".

The door 219 can further include a door handle 236 to facilitate easy opening of the door 219 when the cutting holder 190 is removed from the inflation and sealing assembly 103 so that a user, for example, can remove the blade 192 from the cutter holder 190. While the embodiment shown shows a door 219 it is appreciated that other embodiments may not include the door 219.

The cutter holder 190 can further include a finger opening 238 to receive a user's finger so that the user can easily push or slide the cutter holder 190 along the track 202 between the operative and inoperative positions 206,208. It is appreciated that in some embodiments the finger opening 238 omitted.

In operation of the embodiment shown, the user positions the pegs 204 of the cutter holder 190 within the track 202. The user then slides or pushes the cutter holder 190 along the track 202 and cutter path "H" while applying slight pressure in a transverse direction with respect to the cutter path "H". As the cutter holder 190 is moved toward the inflation nozzle 140, the door 219 concurrently is directed along the track 222 and door path "I" to automatically expose the blade 192. Once in the inoperative position 206, the cutter holder 190 is magnetically held into place. In the embodiment shown, the cutter holder 190 is magnetically held into place by a magnetic influence of the magnet member 216 on the magnet element 214.

In other embodiments, it's appreciated that a cutter housing 190 can be omitted, and other suitable mechanisms can be used to position the blade 192 adjacent the inflation nozzle 140.

It is appreciated, that the cutting assembly 186 described herein can also be used on other types of film handling devices in and inflating and sealing devices. An example is disclosed U.S. Pat. Nos. 8,061,110 and 8,128,770 and Publication No. 2011/0172072.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A flexible structure inflation device, comprising:

an inflation nozzle configured for insertion between first and second overlapping film layers of a web of material, the inflation nozzle and having a fluid conduit extending therethrough configured for directing a fluid in between the layers to inflate the web, and defining a lateral opening; and a cutting member held in an operative position, in which the cutting member is partially received in the lateral opening of the inflation nozzle to cut the film passing over the inflation nozzle; and a guide associating the cutting member with the inflation nozzle to guide the cutting member between the operative position and an inoperative position, in which the cutting member remains associated with the guide, with the guide directing the cutting member into and from the lateral opening, wherein when the cutting member is in the inoperative position, it is spaced from the inflation nozzle.

2. The flexible structure inflation device of claim 1, further comprising a cutter holder that holds the cutting member, the cutting member being magnetically held to the inflation assembly via the cutter holder.

3. The flexible structure inflation device of claim 2, further comprising a cutter assembly that includes the cutter holder and a door depending from the cutter holder and that is movable with respect to the cutting member in the cutter holder between an open position to expose the cutting member in the operative position and a closed position to cover a sharp portion of the cutting member in the inoperative position.

4. The flexible structure inflation device of claim 3, wherein:

the guide includes a track associated with the inflation assembly leading towards and away from the inflation assembly; and the cutter holder includes a follower guided by the track between the operative and an inoperative positions.

5. The flexible structure inflation device of claim 1, further comprising a sealing assembly disposed and configured to seal the first and second layers together to trap the fluid within the web to provide an inflated cushion.

6. The flexible structure inflation device of claim 1, wherein the lateral opening is a slot, and the cutting member is a blade.

7. A flexible structure inflation device, comprising:

an inflation assembly having a fluid conduit configured for inflating with a fluid a cushion cavity disposed between first and second layers of a film;

a cutting member having an operative position adjacent the inflation assembly to cut the film passing over the inflation assembly; and a guide associating the inflation assembly with the cutting member to guide the cutting member between the operative position and an inoperative position, wherein in the operative position, the cutting member is partially received in the inflation assembly; and in the inoperative position, the cutting member is spaced from the inflation assembly.

8. The flexible structure inflation device of claim 7, further comprising a cutter holder that holds the cutting member and is associated with the guide, the guide guiding the movement of the holder to move the cutting member between the operative and inoperative positions, wherein in the inoperative position, the cutting member is removable and replaceable from the guide.

9. The flexible structure inflation device of claim 8, wherein:

the guide includes a track associated with the inflation assembly leading towards and away from the inflation assembly; and the cutter holder includes a follower guided by the track between the operative and an inoperative positions.

10. The flexible structure inflation device of claim 9, wherein the track guides the cutter holder along a cutter path, the track being open on one side transverse to the path to allow the follower to be removed from or positioned on the track at various locations along the track.

11. The flexible structure inflation device of claim 8, wherein the guide includes a track associated with the inflation assembly leading towards and away from the inflation assembly along a cutter path; and further comprising a follower that attaches the cutter holder to the track and configured to allow the cutter holder to be positioned on or removed from the track laterally with respect to the cutter path at various locations along the track.

12. The flexible structure inflation device of claim 11, wherein the cutter holder comprises the follower, which is received within the track.

13. The flexible structure inflation device of claim 12, further comprising a driving member configured for advancing the film along a material path in an inflation direction over the inflation nozzle, wherein:

the inflation nozzle is elongated to fit within an inflation channel between the first and second layers; and the cutting member in the operative association with the inflation nozzle is positioned to cut the inflation channel open to allow the first and second layers to move off from the inflation nozzle.

14. The flexible structure inflation device of claim 13, wherein the cutting member is a blade held stationary with respect to the nozzle in the operative position to cut open the channel as the film is moved along the material path.

15. The flexible structure inflation device of claim 13, wherein the elongated inflation nozzle is configured and oriented to be received longitudinally within the inflation channel defined between the first and second layers to direct fluid therebetween.

16. The flexible structure inflation device of claim 8, wherein:

the guide is configured to guide the cutting member towards and away from the inflation assembly along a cutter path;

the inoperative position comprises a range of inoperative positions within an inoperative zone that extends along the cutter path; and the cutting holder is configured to be removed from the guide laterally with respect to the cutter path, at any location within the inoperative zone.

17. The flexible structure inflation device of claim 12, further comprising:

a first magnet associated with a shuttle or the inflation nozzle; and a magnetic member associated with the other of the shuttle or inflation assembly held magnetically;

wherein the first magnet and the magnetic member magnetically hold the shuttle in the operative position.

18. The flexible structure inflation device of claim 7, wherein:

the inflation assembly has an inflation nozzle through which the fluid conduit extends and that is elongated to fit within an inflation channel between the first and second layers.

19. The flexible structure inflation device of claim 7, further comprising a magnet that holds the cutting member in the operative position magnetically.

20. An inflatable-cushion inflation device, comprising:

an inflation assembly having a fluid conduit configured for inflating with fluid a cushion cavity disposed between first and second layers of a film; and a cutter assembly that includes a cutting member held magnetically in an operative position, the operative position having the cutting member being partially received in an opening on the inflation assembly to cut the film passing over the inflation assembly, the cutter assembly including a door that is open to expose the cutting member in the operative position and closed to cover a sharp portion of the cutting member in an inoperative position; and in the inoperative position, the cutting member is spaced from the inflation assembly.

21. The inflatable-cushion inflation device of claim 20, wherein:

the door is configured to automatically close when the cutter assembly is moved out of the operative position, and the door is configured to automatically open to expose the cutting member when the cutting member is moved to the operative position.

22. The inflatable-cushion inflation device of claim 21, further comprising a guide structure associating the inflation assembly with the cutting member to guide the cutting member between the operative position and an inoperative position and to move the door open and closed as the cutting assembly is moved between the operative and inoperative positions.

23. The flexible structure inflation device of claim 22, further comprising a second guide that engages with a follower attached to the door.

24. The flexible structure inflation device of claim 23, wherein the second guide is a second track, with the first track and the second track diverging as the tracks approach the operative position such that the second track pulls the door away from the blade in the operative position.

25. A flexible structure inflation device, comprising:

an inflation nozzle having a fluid conduit configured for inflating with a fluid a cushion cavity disposed between first and second layers of a film;

a shuttle configured to hold a cutting member in an operative position, in which a sharp portion of the cutting member is exposed and adjacent the inflation nozzle to cut the film passing over the inflation nozzle;

a guide associating the inflation nozzle with the cutting member to guide the shuttle between the operative position and an inoperative position, in which the sharp portion of the cutting member is covered;

a cutter holder that holds the cutting member; and a door movable with respect to the cutter holder;

a second guide operable to partially manipulate the door to open, to expose the sharp portion of the cutting member when the cutting member is moved to the operative position, and to close to cover the sharp portion of the cutting member in the inoperative position; and in the inoperative position, the cutting member is spaced from the inflation nozzle.

26. The flexible structure inflation device of claim 25, further comprising the cutting member.

27. The flexible structure inflation device of claim 25, wherein:

the guide includes a track associated with the inflation assembly leading towards and away from the inflation assembly; and the shuttle includes a follower guided by the track between the operative and an inoperative positions.

28. The flexible structure inflation device of claim 27, wherein the second guide engages with a follower attached to the door.

29. The flexible structure inflation device of claim 28, wherein the first and second guides are first and second tracks that diverge as the tracks approach the operative position such that the second track pulls the door away from the cutting member in the operative position.

30. The flexible structure inflation device of claim 25, wherein the inflation assembly has an inflation nozzle configured for insertion between first and second overlapping film layers of a web of material, the inflation nozzle and having:

the fluid conduit extending therethrough configured for directing a fluid in between the layers to inflate the web; and a lateral opening, in which the sharp portion of the cutting member is partially received in the operative position.

* * * * *